US006857968B2

(12) United States Patent
Fallack

(10) Patent No.: US 6,857,968 B2
(45) Date of Patent: Feb. 22, 2005

(54) APPARATUS FOR TRANSPORTING A POOL TABLE

(76) Inventor: Albert Fallack, 710 Avenue K, Brooklyn, NY (US) 11230

( * ) Notice: Subject to any disclaimer, the term of this patent is extended or adjusted under 35 U.S.C. 154(b) by 12 days.

(21) Appl. No.: 10/173,034

(22) Filed: Jun. 19, 2002

(65) Prior Publication Data

US 2003/0236125 A1 Dec. 25, 2003

(51) Int. Cl.[7] ..... A63D 15/00; A63D 13/00; A63F 9/24

(52) U.S. Cl. ..... 473/33; 473/12; 473/16; 473/4

(58) Field of Search ..... 473/1, 3, 4, 6, 473/9, 10, 12, 14, 15, 496; 273/309; 108/1, 6–10, 23, 147, 133, 143; 312/281, 311, 312

(56) References Cited

U.S. PATENT DOCUMENTS 747,726 A * 12/1903 Karhan ..... 473/9
963,651 A * 7/1910 Rayner ..... 105/394
3,585,945 A * 6/1971 Nielsen ..... 473/15
3,744,812 A * 7/1973 Langhausen ..... 473/15
3,866,913 A * 2/1975 Zimmers et al. ..... 473/435
3,988,021 A * 10/1976 Grover ..... 473/15
4,301,745 A * 11/1981 Dale ..... 473/12
4,305,581 A * 12/1981 Neuharth ..... 473/15
4,519,607 A * 5/1985 Schill ..... 473/12
4,549,320 A * 10/1985 McGivern ..... 473/10
5,746,660 A * 5/1998 Grover ..... 473/15
5,791,758 A * 8/1998 Horgan et al. ..... 473/4
5,882,265 A * 3/1999 Benton ..... 473/15
2004/0033839 A1 * 2/2004 Fallack ..... 473/4

FOREIGN PATENT DOCUMENTS

CA 000744276 A * 10/1966 ..... 473/FOR 30

* cited by examiner

*Primary Examiner*—Mitra Aryanpour

(57) ABSTRACT

The present invention provides an apparatus for transporting a pool table for storing it in a closet. The pool table includes foldable legs. A mechanical assembly is connected to the pool table for moving it between a horizontal playing position and a vertical transport position. A movable dolly with wheels is also provided which is connected to the mechanical assembly for transporting the pool table from a playing location to a second location for storage or playing.

8 Claims, 5 Drawing Sheets

APPARATUS FOR TRANSPORTING A POOL TABLE

FIELD OF INVENTION

The present invention relates to an apparatus for transporting a pool table having a lifting and moving device for moving the pool table between a horizontal playing position and a vertical storage position so it can be stored in a closet or used as a bookcase.

BACKGROUND OF THE INVENTION

Pool tables, while providing gaming enjoyment, often dominate the rooms they are in and take up a lot of space. Thus, there is a need for a pool table that can be moved and stored so as to provide additional space in the room where the pool table is situated.

It is an object of the present invention to provide a pool table that can be easily stored and easily moved into a horizontal playing position.

It is a further object of the present invention to provide a pool table that can be compactly stored in a storage closet.

DISCUSSION OF PRIOR ART

U.S. Pat. No. 3,866,913 discloses a convertible game table assembly with an elongated rectangular table member pivotally mounted on a base with spaced sidewalls for movement between a horizontal table position and a substantially vertical storage position. Two similar game table assemblies having their table members pivoted into a horizontal position may have their ends coupled together to provide for a full size game table, or they may have their table members perpendicularly disposed and abutting to provide a playback table. The bases include shelves for a bookcase assembly with the table member pivoted in the vertical position.

U.S. Pat. No. 4,549,320 discloses furniture which is convertible so as to provide a table for playing snooker or the like or alternatively a bed, which comprises two parts each of box-like construction and of the rectangular platform. One part has an upper surface in the form of a snooker table while the other part has an upstanding side and endwalls which retain a mattress and bedding thereon.

SUMMARY OF INVENTION

The present invention provides an apparatus for transporting a pool table for storing it in a closet. The pool table includes foldable legs. A mechanical assembly is connected to the pool table for moving it between a horizontal playing position and a vertical transport position. A movable dolly with wheels is also provided which is connected to the mechanical assembly for transporting the pool table from a playing location to a second location for storage or playing.

DETAILED DESCRIPTION OF THE PREFERRED EMBODIMENT

Figure 1:
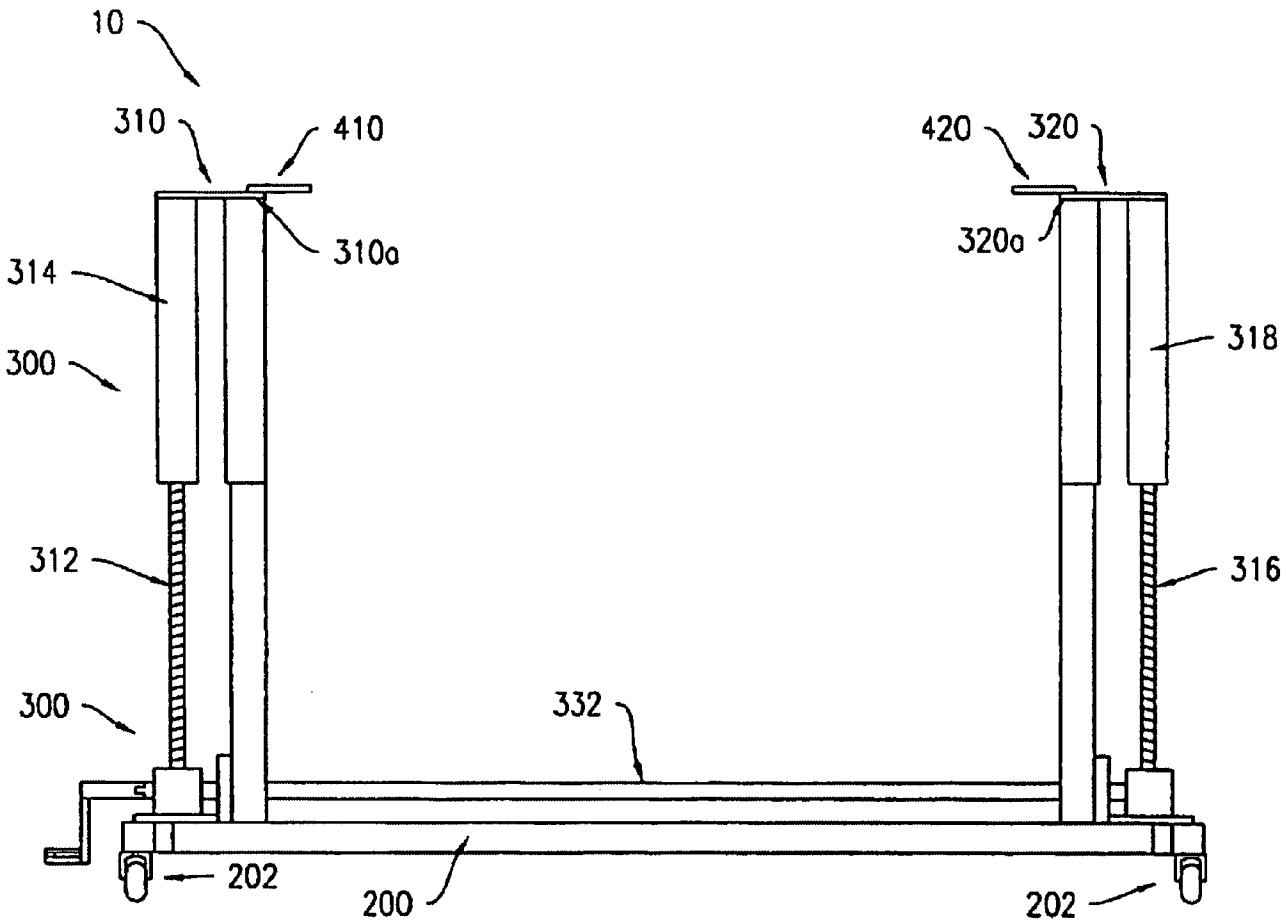
FIG. 1 is a perspective view of the mechanical moving assembly of an apparatus for transporting a pool table.
Figure 2:
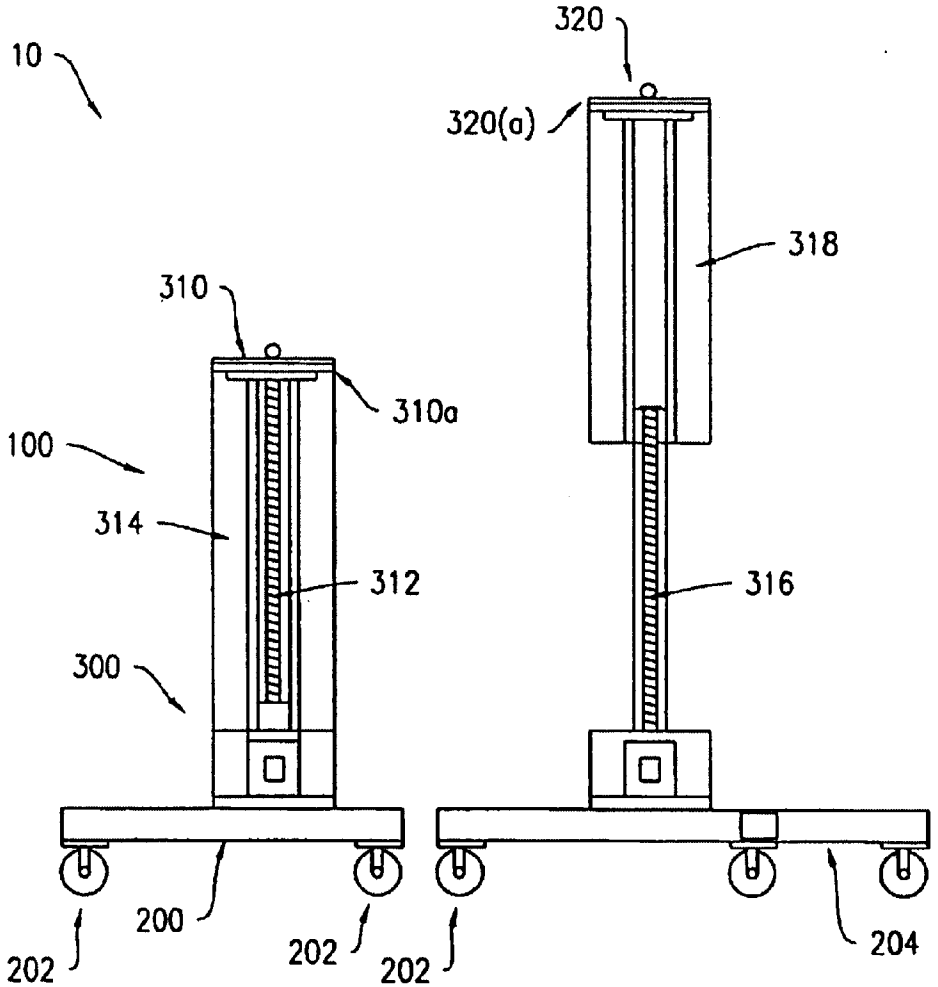
FIG. 2 is a perspective view showing the motion of the mechanical moving assembly of an apparatus for transporting a pool table.
Figure 3:
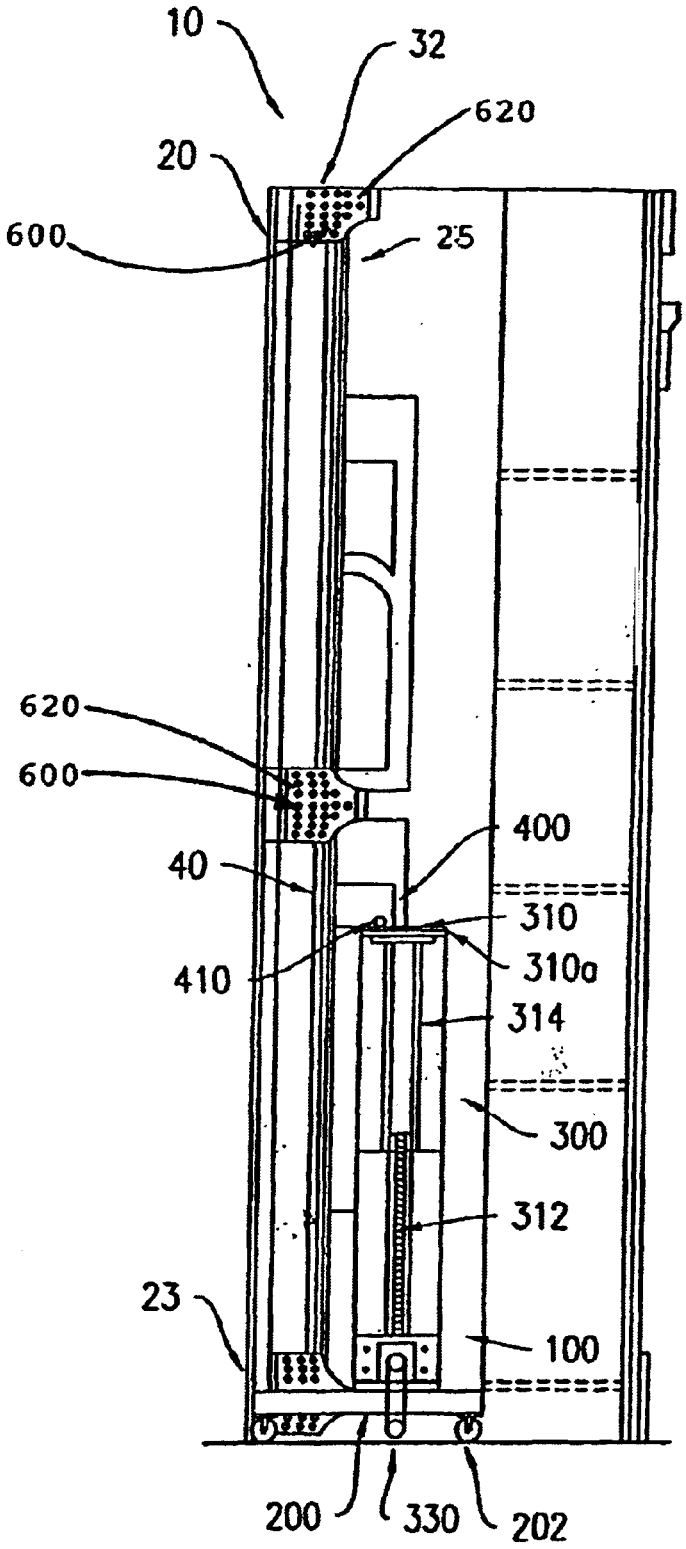
FIG. 3 is a cross sectional view of an apparatus for transporting a pool table.
Figure 4:
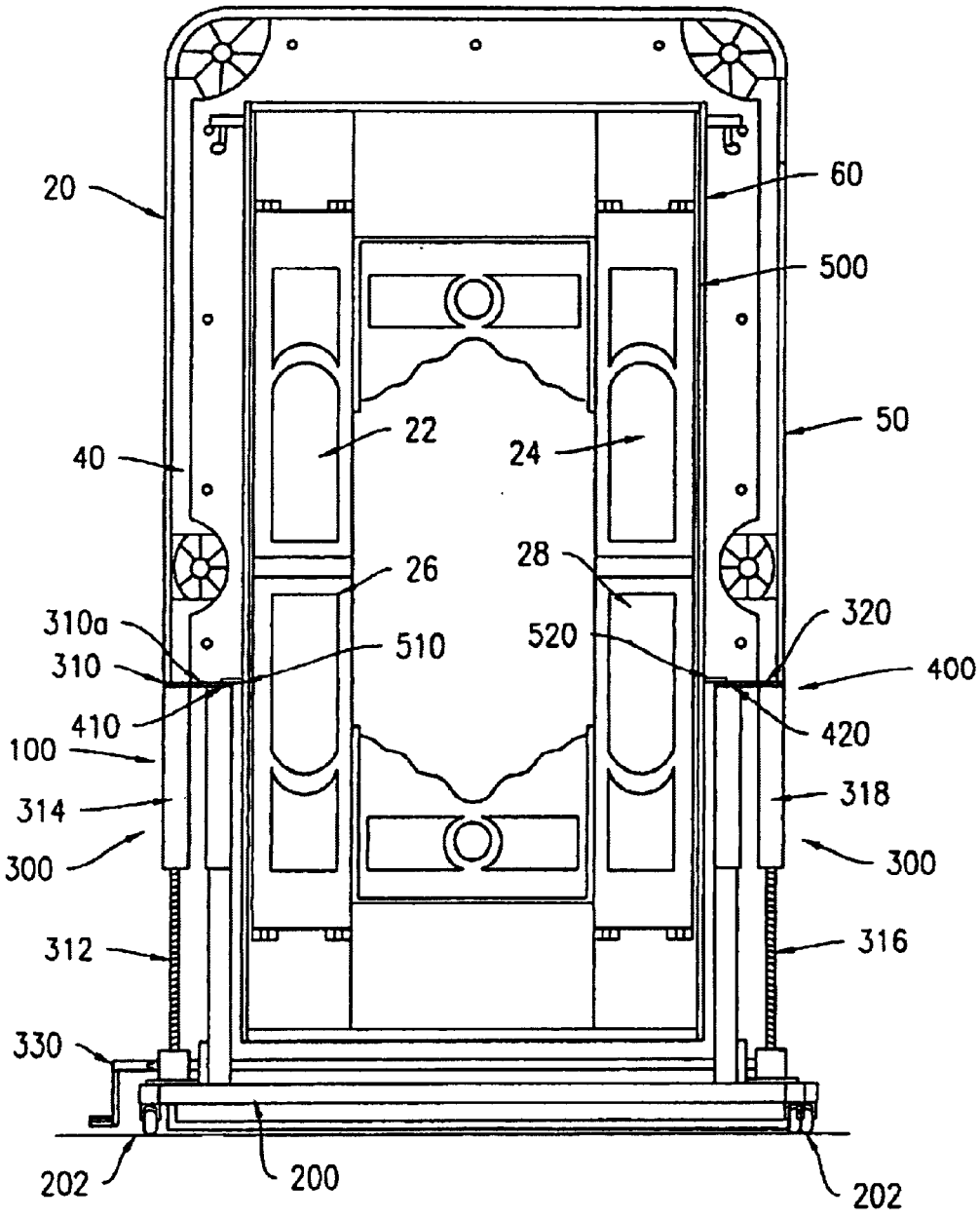
FIG. 4 is a perspective view of an apparatus for transporting a pool table.

FIGS. 1 to 5 show an apparatus 10 for transporting a pool table 20 with legs 22, 24, 26, and 28. A mechanical assembly 100 is connected to the pool table 20 for moving the pool table 20 between a horizontal playing position 30 and a vertical transport position 32. A movable dolly 200 with wheels 202 is connected to the mechanical moving assembly 100 for transporting the pool table 20 from a playing location to a second location for storage or playing. In addition, the movable dolly 200 has an extendable wheel assembly 204 for providing greater stability of the apparatus 10.

The mechanical moving assembly 100 includes a lifting assembly 300 for lifting one (1) end 23 of the pool table 20 and a pivoting assembly 400 for pivoting the other end 25 of the pool table 20 so as to pivot the pool table from a horizontal position 30 to a vertical position 32.

The lifting assembly 300 includes a first lifting device 310 for connection to a first side 40 of the pool table 20, a second lifting device 320 for connection to a second side 50 of the pool table 20 and a cranking device 330 connected to the first and second lifting device 310, 320 by a shaft 332 for operating the first and second lifting devices 310, 320 to lift one (1) end 23 of the table 20. In addition, the first lifting device 310 includes a first screw 312 which is connected to a first piston 314 for raising and lowering the pool table 20. Similarly, the second lifting device 320 includes a second screw 316 which is connected to a second piston 318 for raising and lowering the pool table 20.

The pivoting assembly 400 includes a first pivot rod 410 connected to the first lifting device 310 and to the first side 40 of the pool table 20; a second pivot rod 420 is connected to the second lifting device 320 and to the second side 50 of pool table 20. In this manner, when one end 23 of the pool table 20 is lifted and the legs are folded and locked in place, the other end 25 may be pivoted about the first and second pivot rods 410, 420 to pivot the pool table 20 to a vertical transport position 32.

The first and second lifting devices 310, 320 are mounted on the movable dolly 200 and the first and second pivot rods 410, 420 are connected to the upper ends 310*a* and 320*a* of the first and second lifting devices 310, 320 respectively.

A rectangular-shaped metal frame 500 is connected to the base 60 of the pool table. The metal frame 500 has a first hole 510 for receiving the first pivot rod 410 and a second hole 520 for receiving the second pivot rod 420.

In addition, pool table 20 includes a plurality of directional light sources 600 embedded within the side bumpers 620 of pool table 20 for directing light across the top of the pool table 20.

Figure 5:
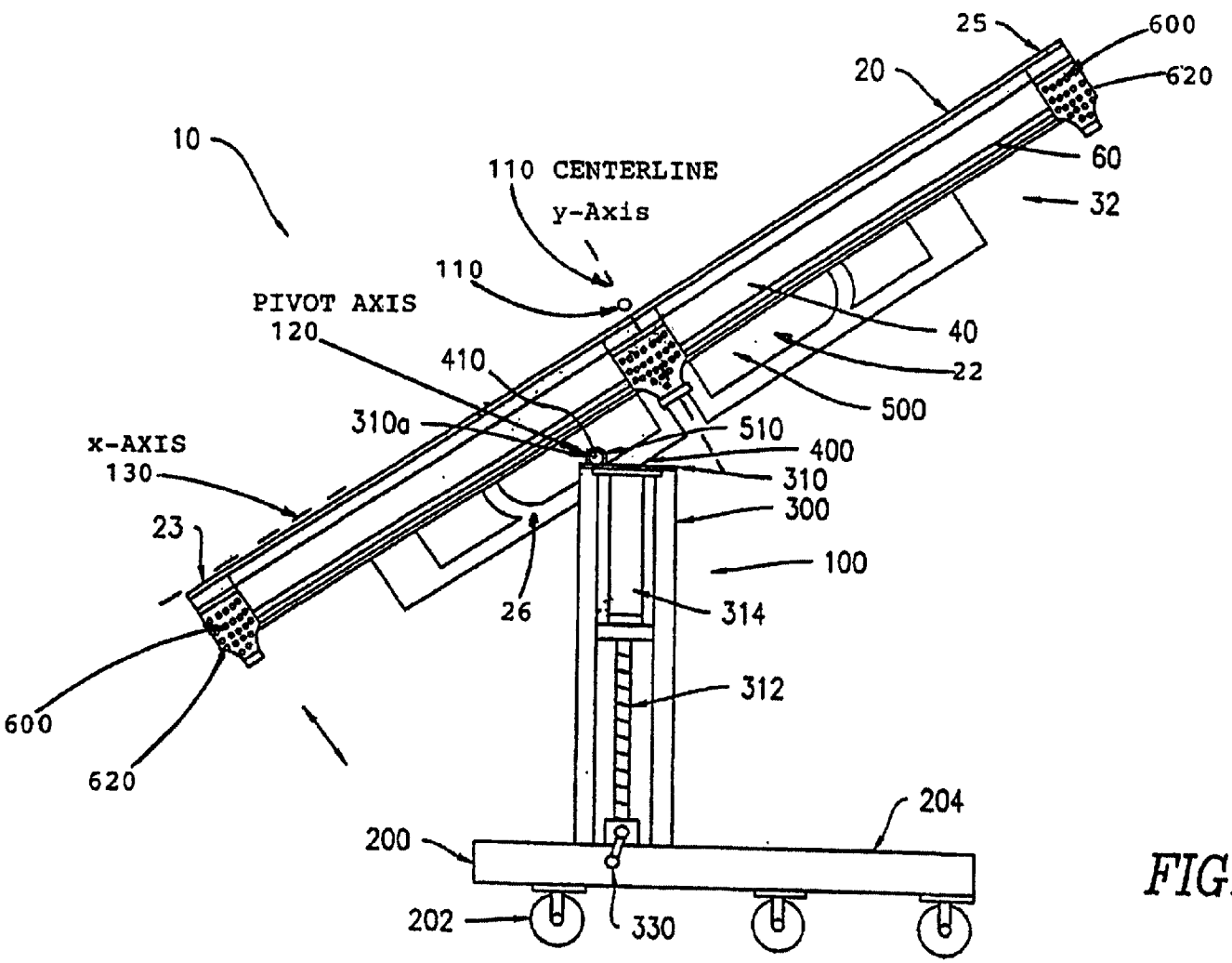
FIG. 5 is a perspective view of an apparatus for transporting a pool table pivoted at a 45° angle about its pivot rods.

Point 110 represents the y-axis 110 extending perpendicular into the plane of the drawing, as shown in FIG. 5. The y-axis 110 is also referred to as a centerline 110. The pivot axis 120 is offset with respect to the centerline 110 of pool table 20. The x-axis 130 extends along the length of pool table 20, as shown in FIG. 5 of the drawings.

OPERATION OF THE PRESENT INVENTION

Apparatus 10 for transporting a pool table 20 with legs 22, 24, 26, and 28 has a mechanical assembly 100 that is connected to the pool table 20 for moving the pool table 20 between a horizontal playing position 30 and a vertical transport position 32. In order to move the pool table 20 between a horizontal playing position 30 and a vertical transport position 32, the operator simply turns the cranking device 330 which turns screws 312 and 316 which in turn raises piston 314 of the first lifting device 310 as well as piston 318 of the second lifting device 320. Pistons 314 and 318 raise the left end 23 of pool table 20 so that legs 26, 28 can be folded under the table 20 and locked in position. Next the right end 25 of the table 20 can now be pivoted upwardly about pivoting rods 410 and 420. The legs 22 and 24 of the right end 25 can now be folded into position so that the table 20 can be pivoted to a vertical position 32 such that the now lower left end 23 of the table 20 can swing freely with respect to the dolly 200. The table 20 is now locked in the vertical storage position 32 and can be wheeled on the dolly 200 to a storage position or to a different playing position. In order to provide the apparatus 10 with greater stability when wheeling the table 20 on the dolly 200, an extendable wheel assembly 204 may be extended from the dolly 200.

ADVANTAGES OF THE PRESENT INVENTION

It is an advantage of the present invention to provide a pool table that can be easily stored and easily moved into a horizontal playing position.

It is a further advantage of the present invention to provide a pool table that can be compactly stored in a storage closet.

A latitude of modification, change, and substitution is intended in the foregoing disclosure, and in some instances, some features of the invention will be employed without a corresponding use of other features. Accordingly, it is appropriate that the appended claims be construed broadly and in a manner consistent with the spirit and scope of the invention herein.

What is claimed is:

1. An apparatus for transporting a pool table, comprising:

a) a pool table with legs; said pool table having an X axis corresponding to the length of the table and having a central Y axis corresponding to a centerline of the table, and a pivot axis parallel to said centerline, said pivot axis being off center relative to said centerline;

b) means for raising and lowering said pivot axis of said pool table;

c) a mechanical moving assembly connected to said pool table for moving said pool table between a horizontal playing position and a vertical transport position about said off center pivot axis; and d) a movable dolly having wheels being connected to said mechanical moving assembly for transporting said pool table from a playing location to a second location for storage or playing.

2. An apparatus in accordance with claim 1, wherein said mechanical moving assembly includes a lifting assembly for lifting one end of said pool table, and a pivoting assembly for pivoting the other end of said pool table, so as to pivot said pool table from a horizontal position to a vertical transport position.

3. An apparatus in accordance with claim 2, wherein said lifting assembly includes a first lifting device for connection to a first side of said pool table, a second lifting device for connection to a second side of said pool table, and a cranking device connected to said first and second lifting devices for operating said first and second lifting devices.

4. An apparatus in accordance with claim 3, wherein said pivoting assembly includes a first pivot rod connected to said first lifting device and to said first side of said pool table, and a second pivot rod connected to said second lifting device and to said second side of said pool table, so that when one end of said pool table is lifted, the other end may be pivoted about said first and second pivot rods to pivot said pool table to a vertical transport position.

5. An apparatus in accordance with claim 4, wherein said first and second lifting devices are mounted on said movable dolly, and wherein said first and second pivot rods are connected to the upper ends of said first and second lifting devices, respectively.

6. An apparatus in accordance with claim 5, wherein a rectangular-shaped metal frame is connected to the base of said pool table, and wherein said metal frame has a first hold formed herein for receiving said first pivot rod, and wherein said metal frame has a second hole formed therein for receiving said second pivot rod.

7. An apparatus in accordance with claim 3, wherein said first lifting device includes a first screw which is connected to a first piston for raising and lowering said pool table, and wherein said second lifting device includes a second screw which is connected to a second piston for raising and lowering said pool table.

8. An apparatus in accordance with claim 1, wherein said movable dolly has an extendable wheel assembly for providing greater stability of said apparatus.

* * * * *